US005458699A

United States Patent [19]

Tsukamoto et al.

[11] Patent Number: 5,458,699

[45] Date of Patent: Oct. 17, 1995

[54] STEEL WIRE FOR MAKING HIGH STRENGTH STEEL WIRE PRODUCT AND METHOD FOR MANUFACTURING THEREOF

[75] Inventors: Takashi Tsukamoto; Terutaka Tsumura; Masatake Tomita; Michitaka Fujita; Motoo Asakawa, all of Kitakyushu, Japan

[73] Assignee: Sumitomo Metal Industries, Ltd., Osaka, Japan

[21] Appl. No.: 240,369

[22] Filed: May 10, 1994

[30] Foreign Application Priority Data

May 13, 1993 [JP] Japan ..... 5-111315

[51] Int. Cl.[6] ..... C22C 38/02; C21D 8/06

[52] U.S. Cl. ..... 148/320; 148/598

[58] Field of Search ..... 148/598, 320

[56] References Cited

U.S. PATENT DOCUMENTS 5,156,692 10/1992 Tsukamoto ..... 148/598

FOREIGN PATENT DOCUMENTS 53-30917 3/1978 Japan .

57-19168 4/1982 Japan .

3-240919 10/1991 Japan .

*Primary Examiner*—Deborah Yee

*Attorney, Agent, or Firm*—Burns, Doane, Swecker & Mathis

[57] ABSTRACT

A steel wire for making a high strength steel wire product which contains 0.6–1.1% C, 0.2–0.6% Si, 0.3–0.8% Mn, and impurities of max 0.010% P, max 0.010% S, max 0.003% O(oxygen), and max 0.002% N, and has a structure in which the maximum pearlite block size is 4.0 μm, the maximum separation distance in pearlite lamellars is 0.1 μm, and the maximum content of free ferrite is 1% by volume.

The steel wire can be manufactured in the process as follows;

① heating a steel wire rod having above-mentioned chemical composition to the austenite range above $Ac_3$ point or $A_{cm}$ point, ② initiating plastic deformation to not less than 20% total reduction in cross-sectional area in the temperature range 850° C. –750° C., ③ finishing plastic deformation in the range below $Ae_1$ point and above 650° C., and ④ continuously cooling to a range lower than 650° C. and higher than 550° C., and thus transforming into pearlite phase.

18 Claims, 3 Drawing Sheets

STEEL WIRE FOR MAKING HIGH STRENGTH STEEL WIRE PRODUCT AND METHOD FOR MANUFACTURING THEREOF

FIELD OF THE INVENTION

This invention relates to a steel wire which has good workability and is worked by cold-drawing to produce high strength steel wire products, particularly high strength and ductile work-hardened type steel wire, and a method of producing such steel wire.

BACKGROUND OF THE INVENTION

The maximum strength of so-called cold-drawn work-hardened steel wire which is produced by means of cold-drawing down to a final diameter of about 0.2 mm is usually about 320 kgf/mm$^2$.

In the process of producing such steel wire, the final cold-drawing is performed with the reduction ratio (l n $\epsilon$) at nearly 3.2. When, for example, a cold-drawn steel wire of about 0.2 mm diameter is produced from a steel wire rod of 5.5 mm diameter, several repetitions of LP(lead parenting) heat treatment and cold-drawing are required in order to achieve a specific strength.

FIG. 5 shows a typical conventional process flow diagram for production of the cold-drawn steel wire product. According to this process, the 1.2 mm ø steel wire of about 125 kgf/mm$^2$ tensile strength is made from a 5.5 mm ø steel wire rod by repetitions of drawing and intermediate LP (dipping the material in a lead bath at about 600° C. after heating it at above 900® ). The steel wire is further drawn at the drawing ratio mentioned above to produce the final steel wire product which has a 0.2 mm diameter and about 320 kgf/mm$^2$ tensile strength.

In this process at these conditions, however, further increase of the drawing reduction ratio in order to raise the tensile strength to above 320 kgf/mm$^2$ is impossible due to loss of ductility of the material.

FIG. 6 shows an example of the relation between the drawing reduction l n ($A_o/A_n$), and the consequent tensile strength and RA (reduction in area), where $A_o$ stands for the cross sectional area of the steel wire before drawing, $A_n$ for that after n times (n passes) drawing, and $\epsilon$ is $A_o/A_n$.

As is shown in FIG. 6, the strength of the drawn wire product gradually increases as the process of drawing proceeds.

When a conventional steel wire of eutectoid composition with 1–2 mm diameter is cold-drawn and combined with LP treatment, the strength arrives at the maximum value of about 320 kgf/mm$^2$ at l n $\epsilon$=3.2, as mentioned above.

We inventors have disclosed in Japanese Patent Publication No.3-240919 a method of producing a steel wire for making the cold-drawn wire product, wherein the steel wire rod with 0.7–0.9% carbon is heated to austenite temperature above $Ac_3$ point, then cooled to a temperature range below $Ae_1$ point and above 500° C. at the cooling rate that would not come across the pearlite transformation starting temperature, to produce a steel wire having subcooled austenite. Thereafter, the steel wire is transformed after cold working with a cross-sectional area reduction of over 20%.

According to the method disclosed in the above mentioned Japanese Patent Publication, crystallographic grains (pearlite blocks) are refined to about 5 μm by thermomechanical treatment, and the separation distance between pearlite lamellars is controlled to a coarseness of about 0.15 μm. Therefore, the obtained steel wire for cold drawing has a tensile strength grade of 115 kgf/mm$^2$. The cold-drawn steel wire product made from the steel wire can have a tensile strength of about 410 kgf/mm$^2$ by finally drawing at a reduction ratio close to l n $\epsilon$=4.9.

In the process of Japanese Patent Publication No.3-220919, however, due to delayed recovery and obstructed recrystallization of austenitic structure, excessive amounts of residual deformed structure causes generation of free ferrite grains during pearlite dissociation process. The ferritic structure is a factor that inhibits attaining high strength in the final drawing process, due to a loss of ductility and insufficient work hardening.

For this reason, the maximum tensile strength of the cold-drawn steel wire product is limited to 410 kgf/mm$^2$ grade, even if the 115 kgf/mm$^2$ level steel wire is cold-drawn at a working ratio close to l n $\epsilon$=2.9.

Furthermore, such a high working ratio tends to generate internal defects, subsequently lower the ductility of the wire product, and deteriorate its fatigue strength.

OBJECTS OF THE INVENTION

One object of the present invention is to provide a steel wire for making a cold-drawn and work-hardened high strength steel wire product which has a tensile strength above 410 kgf/mm$^2$, a reduction of area in the range of 20–50% and a twisting number beyond 30 turns.

Another object of the present invention is to provide a method for producing the above-mentioned steel wire.

SUMMARY OF THE INVENTION

The steel wire and the method of production of this invention are as mentioned below.

(1) A steel wire for making a high strength steel wire product which is characterized by containing, in % by weight, 0.6–1.1% C, 0.2–0.6% Si, and 0.3–0.8% Mn, and impurities of max 0.010% P, max 0.010% S, max 0.003% O(oxygen), and max 0.002% N, and having a structure in which the maximum pearlite block size is 2.0 μm, the maximum separation distance in pearlite lamellars is 0.1 μm, and the maximum content of free ferrite is 1% by volume.

(2) A method for manufacturing a steel wire for making a high strength steel wire product characterized by;

① heating a steel wire rod containing, in % by weight, 0.6–1.1% C, 0.2–0.6% Si, and 0.3–0.8% Mn, and impurities of max 0.010% P, max 0.010% S, max 0.003% O(oxygen), and max 0.002% N to the austenite range above $Ac_3$ point or $A_{cm}$ point, ② initiating plastic deformation to not less than 20% total reduction in cross-sectional area in the temperature range 850° C.–750° C., ③ finishing plastic deformation in the range between $Ae_1$ point and 650° C., and ④ cooling continuously to the range between 650° C. and 550° C., and thus transforming into the pearlite phase.

The steel wire of (1) and the steel wire rod of (2) can further contain one or more alloying elements selected from—

B: 0–0.005%, preferably 0.002–0.005%,

Nb: 0–0.010%, preferably 0.002–0.010%,

Cr: 0–1.0%, preferably 0.1–1.0%,

V: 0–0.3%, preferably 0.01–0.3%,

Ni: 0–1.0%, preferably 0.05–1.0%,

Mo: 0–0.20%, preferably 0.01–0.20%, and one or more rare earth metals of 0–0.10%, preferably 0.01–0.10%.

DETAILED DESCRIPTION

Figure 1:
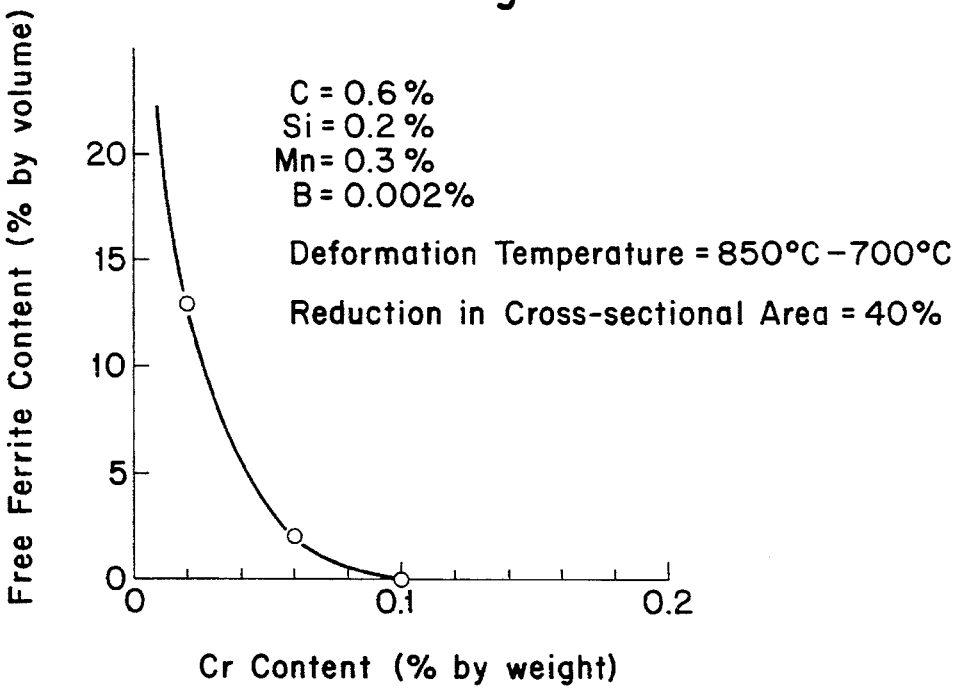
FIG. 1 shows the effect of Cr content on the volume percentage of free ferrite.

[I] Chemical composition of the steel wire rod

The reasons for determining the chemical composition of the steel wire as mentioned above are given. The "%" indicates percent by weight in the following.

C: Carbon is a necessary element to secure the strength of steel, and its content also influences the behavior of ferrite formation when thermomechanical treatment is performed as mentioned above. The target tensile strength, not less than 410 kgf/mm$^2$ of the steel wire product is not attained, and free ferrite tends to form with a carbon content of less than 0.6%.

On the other hand, when carbon content is higher than 1.1%, precipitation of pro-eutectoid cementite is inevitable, even if all elements other than carbon are kept within the ranges in accordance with this invention. Therefore, the preferable range of carbon content is 0.6–1.1%.

Si: Silicon is a necessary element as a deoxidizing agent, and to secure the strength of steel. Si of less than 0.2% is insufficient to secure the strength and to attain the deoxidizing effect. On the other hand, material workability deteriorates with Si of more than 0.6%, and the target strength is also unattainable. Therefore, the preferable range of silicon content is 0.2–0.6%.

Mn: Manganese is also a necessary element to secure the strength of steel. When Mn is less than 0.3%, the target strength cannot be attained. If, on the other hand, Mn is more than 0.8%, ductility of pearlite decreases. Therefore, the preferable range of manganese content is 0.3–0.8%.

P: Since phosphorus is soluble in the ferrite phase and decreases ductility, which results in a decrease of workability of the steel wire, the content of phosphorus should be limited to less than 0.010%.

B: Sulphur is present in steel as inclusions and deteriorates the drawing workability of the steel wire. The content of sulphur therefore should be limited to less than 0.010%.

O(oxygen): Oxygen forms precipitates of oxide in the steel wire rod and deteriorates drawing workability of it. The content of oxygen therefore should be limited to less than 0.0035.

N: Nitrogen is soluble in the ferrite phase, and causes strain aging in the drawing process and deteriorates ductility. The content of nitrogen should therefore be limited to less than 0.0025.

The steel wire of this invention may contain one or more alloying elements selected from B, Nb, Cr, V, Ni and Mo.

B: Boron promotes growth of the cementite phase and enhances ductility of the steel wire. B is not effective with a content of less than 0.002%, while a content of B in excess of 0.0055 tends to generate internal fractures in warm or hot deformation of the austenite phase. The preferable content of boron is, therefore, within the range of 0.002–0.005%.

Nb: Niobium has the effect of refining the austenite crystal grains prior to transformation. Nb content of less than 0.002%, however,is not effective. When more than 0.010% Nb is present in steel, NbC preferentially precipitates during warm or hot deformation in the austenite phase, and deteriorates drawing workability. The preferable content of niobium, therefore, is within the range of 0.002–0.010%.

Cr: Chromium is an effective element for enhancing the strength of the steel wire product and suppressing the generation of free ferrite after working of the austenite phase.

FIG. 1 shows the effect of chromium content on the volume percentage of free ferrite, and shows the decrease in generated free ferrite volume percentage with an increasing chromium content. This figure clearly indicates that the amount of free ferrite increases with a chromium content below 0.1%. Ductility deteriorates, however, with more than 1.0% chromium because the cementite platelets in the pearlite phase will not grow sufficiently. For these reasons the preferable content of chromium is 0.1–1.0%.

V, Ni, and Mo: Vanadium and nickel are alloying elements that increase the strength of the steel wire product. Vanadium of not less than 0.01% has a recognizable effect on the strength. However, more than 0.30% vanadium decreases ductility. Preferable Vanadium content, therefore, is more than 0.01% and less than 0.3%.

Not less than 0.05% nickel increases the strength of the steel wire product, and also increases the ratio of work hardening. Ductility, however, decreases for nickel content above 1.0%. Therefore, nickel content should be preferably limited to 0.05–1.0%.

Not less than 0.01% molybdenum increases the strength of the steel wire having the eutectoid phase. However, molybdenum in excess of 0.20% decreases the ductility, and also makes heat treatment difficult due to the long time required for phase transformation. Molybdenum content should therefore be limited preferably to 0.10–0.20%.

The steel wire of this invention may also contain one or more rare earth metals (referred to as REM hereafter), preferably within the range of 0.01–0.10% respectively.

While the refining of crystal grains and the subsequent effect of enhanced ductility are expected by the working of the austenite phase in accordance with the specifications of this invention, the addition of not less than 0.01% of REM results in even better ductility. REM in excess of 0.10%, on the contrary, deteriorates ductility. Therefore, the preferable content of REM is 0.01–0.10% respectively.

[II] Manufacturing process and conditions

The following description gives reasons for restrictions of the manufacturing process and conditions of thermomechanical treatment together with the effect of these.

(a) Heating temperature of the steel wire rod

The steel wire rod to be supplied for the manufacturing process of this invention should have been prepared by means of oxygen converter steel making, continuous casting, and hot rolling normally to a diameter of about 5.5 mm. This rod is heated to above $Ac_3$ temperature or $A_{cm}$ temperature.

The heating temperature range above $Ac_3$ or $A_{cm}$ was chosen in order to have a complete solid solution of carbide in the austenite phase prior to thermomechanical treatment.

(b) Conditions for plastic deformation

Figure 2:
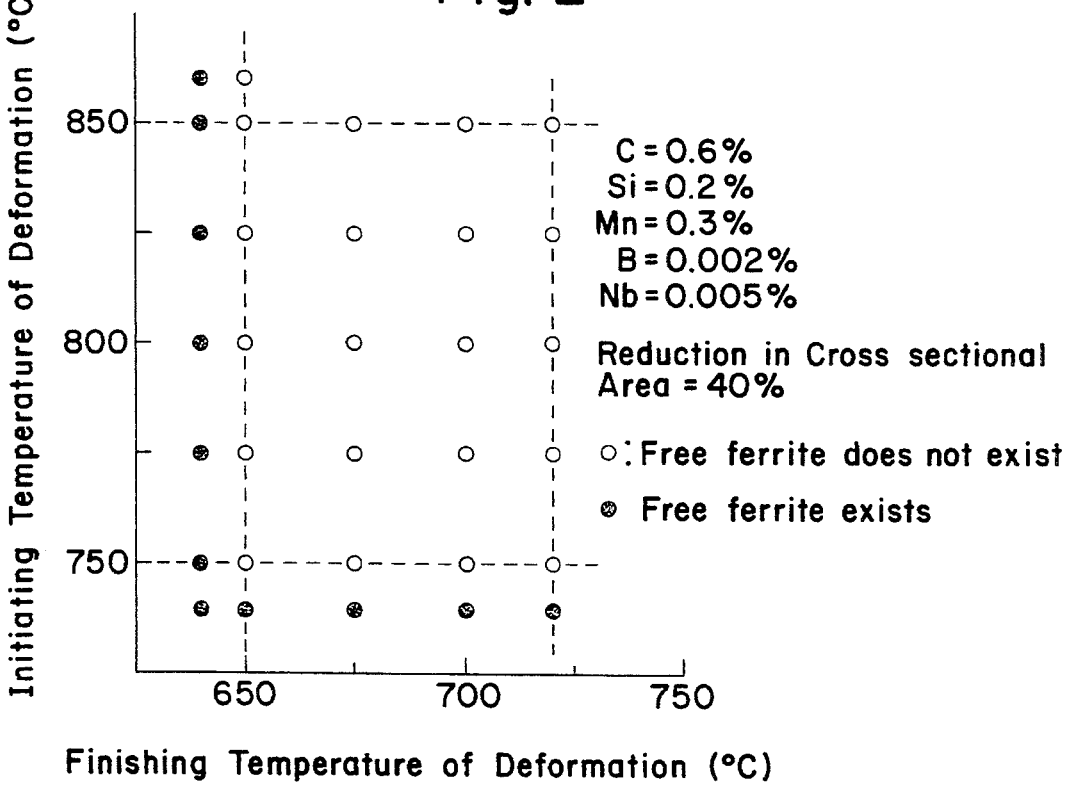
FIG. 2 shows the effect of the initiating and the finishing temperatures of plastic deformation on the formation of free ferrite.

The reasons for setting the initial temperature of plastic deformation of the austenite phase in the range of not higher than 850° C. and not lower than 750° C., the finishing temperature range of not higher than $Ae_1$ temperature and not lower than 650° C., and the total deformation reduction of not less than 20% in area are described below:

FIG. 2 shows the influence of the initial and finishing temperatures of plastic deformation on the formation of free ferrite. In cases where the initial temperature of plastic deformation is below 750° C. or the finishing temperature is below 650° C., free ferrite is formed. This indicates insufficient recovery and recrystallization of austenite after deformation in this temperature range. On the other hand, if the initial work temperature is higher than 850° C., the recrystallized grain size becomes coarse, irrespective of the formation of free ferrite.

In addition, a finishing temperature of plastic deformation above $Ae_1$ enhances recovery of austenite and recrystallization, resulting in a lack of well developed crystal (pearlite block) texture orientation. For a finishing temperature below 650° C. precipitation of free ferrite is unavoidable.

The reasons for 20% for the minimum total reduction in area of deformation are presented below.

Figure 3:
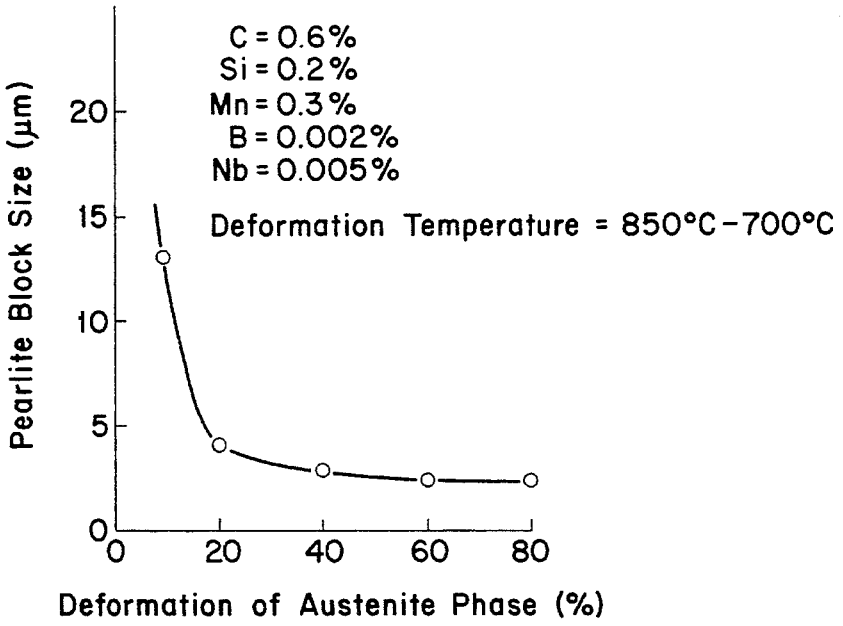
FIG. 3 shows the effect of the deformation (the ratio of the total reduction in cross sectional area) of austenite phase on the pearlite block size.

FIG. 3 shows the influence of the total reduction in area of austenite deformation on the pearlite block size. Preferable refinement (to less than 2.0 μm ) of the pearlite block size, as can be seen in FIG. 3, is remarkably revealed in the range of not less than 20% total reduction in area. Namely, the total reduction in the area of deformation should be required to be not less than 20% in order to acquire a preferable structure after continuous cooling is finished as mentioned below.

Furthermore, the plastic deformation should preferably be carried out at a constant working ratio from the initial step of deformation, keeping the working range of temperature and the total reduction in area of work as stipulated above. Namely, deformation in the higher temperature side within the range of deformation temperature as stipulated above accelerates recrystallization of the austenite phase and refines the crystallographic grain size. On the other hand, deformation in the lower temperature side of the same range increases the nucleii for pearlite formation by retaining the deformation strain. In order to secure these effects under the above mentioned conditions, it is further preferable to have the work carried out, from the initial deformation (at higher temperature) through the final deformation (at lower temperature) at a constant working ratio.

(c) Conditions for continuous cooling

After the plastic deformation, the steel wire rod is continuously cooled down to the temperature range between 650° C. and 550° C. in order for the pearlite transformation to be carried out, the reasons for which are as mentioned below.

The required strength cannot be obtained with a finishing temperature of cooling above 650° C. because the lamellar structure becomes too coarse. On the other hand, if the temperature of cooling is below 550° C., low temperature transformation structure is formed, thereby deteriorating ductility. The faster the cooling rate the finer the pearlite lamellar structure becomes.

(d) Structure of the steel wire

The crystallographic structure of the steel wire for cold-work hardened high strength wire product should satisfy the following three conditions at the same time in order to obtain the required strength.

① The pearlite block size should be not more than 4.0 μm.

② The pearlite lamellar separation distance should be not more than 0.1 μm.

③ The ratio of free ferrite should be not more than 1 volume %.

As has been mentioned above, fine grain structure without free ferrite is realized by thermomechanical treatment. This treatment controls crystal structure, and further improves crystal structure orientation, enabling a steel wire of enhanced ductility to be obtained. The steel wire product is made from the steel wire by a high cold-work ratio such as $1\ n\epsilon \geqq 4.0$ to exhibit a reduction ratio of area as high as 40–50%, a level of the number of twists as high as more than 30 turns, and the level of tensile strength being at least 410 $kgf/mm^2$, but preferably 430–450 $kgf/mm^2$, Pearlite block size of over 4.0 μm deteriorates workability of the steel wire, and a strength exceeding 410 $kgf/mm^2$ for the wire product is not obtainable. With a separation distance between pearlite lamellars of over 0.1 μm, the target product strength is also unattainable. Furthermore, with the free ferrite volume in excess of 1 volume %, the limit of drawing workability decreases and the target product strength is unattainable.

Figure 4A:
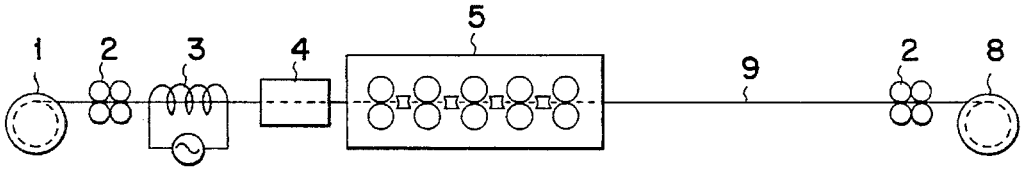
FIG. 4 shows examples of facilities to embody the method of this invention.
Figure 4B:
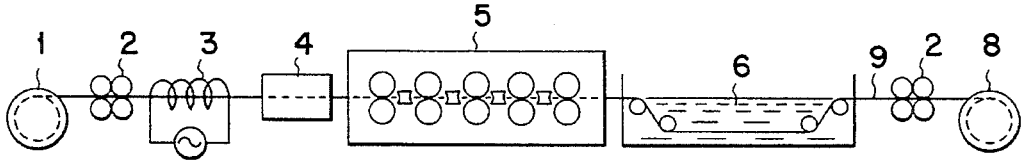
Figure 4C:
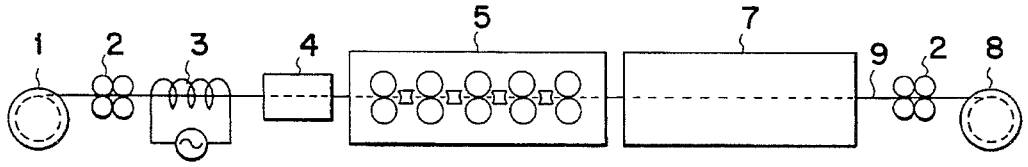
Figure 5:
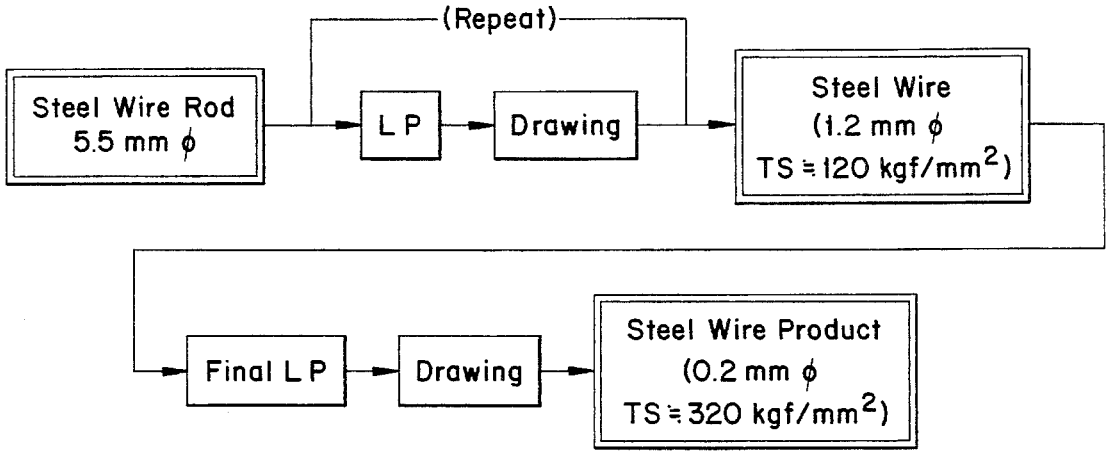
FIG. 5 shows a flow diagram of a conventional steel wire product manufacturing process.
Figure 6:
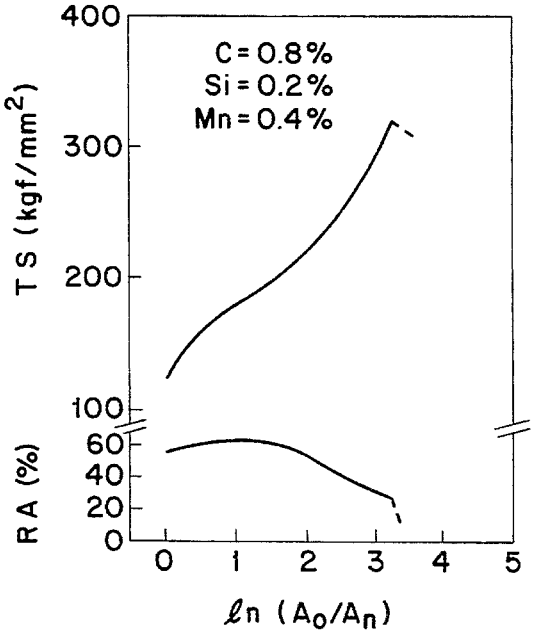
FIG. 6 shows the effect of the reduction ratio on the tensile strength and the contraction of area in the case of conventional technology.

FIG. 4 shows an outline of the thermomechanical treatment equipment in which the method of this invention is carried out.

FIG. 4(*a*) shows a schematic diagram of a facility consisting of pinch rolls (2), rapid heating equipment (3), for example an induction heater, cooling equipment (2), for example water cooling equipment, a series of machines for plastic deformation of so-called micro-mill (5), and pinch rolls (2) at the exit. The method of continuous cooling of the steel wire (9) after plastic deformation in this facility is air cooling. The facility also has a payoff reel (1) and a take-up reel (8).

Electric resistance heating method for the rapid heating equipment and air cooling method for the cooling equipment can be applied respectively. The water cooling equipment (2) can be a dipping type, and for both cases of water cooling and air cooling it is preferable that heating patterns can be varied in order to control the structure, and also that the distance between the cooling equipment and the subsequent rolling mill can be varied.

The wire rod is heated to a prescribed temperature by the rapid heating device such as an induction heater (3) as described above. It is then cooled to another prescribed temperature by a cooling device like the one described above, and this is followed by plastic deformation under the prescribed conditions in the continuous rolling mill like the micro-mill (5) as described above. In this case, for example, the plastic deformation at a constant temperature can be effected by controlling the cooling water flow, and adjusting the control valves at each roll stand in the micro-mill (5) in order to preserve the balance between heating of the wire rod by rolling and its cooling. After plastic deformation, the phase is transformed into pearlite by continuous air cooling at the prescribed temperature.

FIG. 4 (*b*) shows the method of continuous cooling after plastic deformation in a lead bath (6) for lead patenting between the micro-mill (5) and the exit pinch rolls (2).

FIG. 4 (*c*) shows a floating bed (7) using oxide of Si, Al, etc. instead of the lead bath (6).

EXAMPLES

Steel wire rods of No's 1–28 as shown in Tables 1 and 2, all of which have a diameter of 5.5 mm, were prepared by being melted in an 150 kg vacuum melting furnace, forged, and rolled in the conventional process. They were put to thermomechanical treatment in the process as shown in FIG. 4 (*b*).

TABLE 1

| Steel | Chemical Composition (wt %, Fe: bal.) | | | | | | | | | | | | | | | |
|---|---|---|---|---|---|---|---|---|---|---|---|---|---|---|---|---|
| No. | C | Si | Mn | P | S | Cr | O | N | B | Nb | V | Ni | Mo | La | Ce | Remarks |
| 1 | 0.55 | 030 | 0.40 | 0.010 | 0.010 | — | 0.0029 | 0.0039 | 0.0025 | 0.0025 | — | — | — | — | — | |
| 2 | 0.60 | 0.30 | 0.41 | 0.009 | 0.010 | — | 0.0030 | 0.0040 | 0.0027 | 0.0024 | — | — | — | — | — | ○ |
| 3 | 0.80 | 0.31 | 0.40 | 0.009 | 0.009 | — | 0.0029 | 0.0039 | 0.0023 | 0.0022 | — | — | — | — | — | ○ |
| 4 | 1.10 | 0.30 | 0.40 | 0.010 | 0.008 | — | 0.0030 | 0.0040 | 0.0027 | 0.0022 | — | — | — | — | — | ○ |
| 5 | 1.20 | 0.31 | 0.42 | 0.010 | 0.009 | — | 0.0028 | 0.0038 | 0.0025 | 0.0025 | — | — | — | — | — | |
| 6 | 0.80 | 0.15 | 0.40 | 0.009 | 0.010 | — | 0.0030 | 0.0039 | 0.0027 | 0.0026 | — | — | — | — | — | |
| 7 | 0.82 | 5.20 | 0.40 | 0.009 | 0.009 | — | 0.0029 | 0.0039 | 0.0024 | 0.0026 | — | — | — | — | — | ○ |
| 8 | 0.80 | 0.60 | 0.41 | 0.010 | 0.008 | — | 0.0030 | 0.0040 | 0.0025 | 0.0025 | — | — | — | — | — | ○ |
| 9 | 0.81 | 0.65 | 0.40 | 0.009 | 0.009 | — | 0.0029 | 0.0039 | 0.0023 | 0.0027 | — | — | — | — | — | |
| 10 | 0.80 | 0.31 | 0.26 | 0.008 | 0.009 | — | 0.0028 | 0.0038 | 0.0025 | 0.0022 | — | — | — | — | — | |
| 11 | 0.82 | 0.30 | 0.30 | 0.008 | 0.008 | — | 0.0030 | 0.0040 | 0.0021 | 0.0023 | — | — | — | — | — | ○ |
| 12 | 0.80 | 0.32 | 0.80 | 0.009 | 0.009 | — | 0.0030 | 0.0040 | 0.0027 | 0.0025 | — | — | — | — | — | ○ |
| 13 | 0.80 | 0.31 | 0.90 | 0.010 | 0.010 | — | 0.0029 | 0.0039 | 0.0026 | 0.0024 | — | — | — | — | — | |
| 14 | 0.82 | 0.30 | 0.41 | 0.007 | 0.010 | — | 0.0030 | 0.0040 | 0.0025 | 0.0027 | — | — | — | — | — | ○ |
| 15 | 0.80 | 0.31 | 0.40 | 0.010 | 0.009 | — | 0.0028 | 0.0038 | 0.0023 | 0.0027 | — | — | — | — | — | ○ |
| 16 | 0.81 | 0.30 | 0.42 | 0.015 | 0.008 | — | 0.0030 | 0.0040 | 0.0022 | 0.0026 | — | — | — | — | — | |
| 17 | 0.80 | 0.31 | 0.41 | 0.010 | 0.008 | — | 0.0029 | 0.0039 | 0.0025 | 0.0024 | — | — | — | — | — | ○ |
| 18 | 0.80 | 0.32 | 0.40 | 0.009 | 0.010 | — | 0.0030 | 0.0040 | 0.0023 | 0.0025 | — | — | — | — | — | ○ |
| 19 | 0.80 | 0.30 | 0.41 | 0.009 | 0.015 | — | 0.0028 | 00038 | 0 0024 | 0.0026 | — | — | — | — | — | |
| 20 | 0.80 | 0.30 | 0.41 | 0.010 | 0.010 | 0.10 | 0.0029 | 0.0039 | 0.0022 | 0.0027 | — | — | — | — | — | ○ |
| 21 | 0.80 | 0.31 | 0.40 | 0.009 | 0.009 | 0.70 | 0.0030 | 0.0040 | 0.0022 | 0.0025 | — | — | — | — | — | ○ |
| 22 | 0.82 | 0.30 | 0.41 | 0.009 | 0.008 | 1.00 | 0.0030 | 0.0040 | 0.0027 | 0.0024 | — | — | — | — | — | ○ |
| 23 | 0.80 | 0.31 | 0.42 | 0.009 | 0.010 | — | 0.0030 | 0.0040 | 0.0025 | 0.0024 | — | — | — | — | — | ○ |
| 24 | 0.81 | 0.30 | 0.40 | 0.008 | 0.009 | — | 0.0040 | 0.0039 | 0.0026 | 0.0027 | — | — | — | — | — | |
| 25 | 0.80 | 0.30 | 0.42 | 0.008 | 0.008 | — | 0.0030 | 0.0040 | 0.0023 | 0.0027 | — | — | — | — | — | ○ |
| 26 | 0.80 | 0.31 | 0.41 | 0.009 | 0.009 | — | 0.0028 | 0.0050 | 0.0024 | 0.0025 | — | — | — | — | — | |
| 27 | 0.80 | 0.30 | 0.41 | 0.009 | 0.009 | — | 0.0030 | 0.0040 | 0.0020 | — | — | — | — | — | — | ○ |
| 28 | 0.83 | 0.31 | 0.40 | 0.010 | 0.010 | — | 0.0030 | 0.0038 | 0.0040 | — | — | — | — | — | — | ○ |

Note:
1. Underlined values are beyond the scope of the Present Invention.
2. "○" indicates the composition of the Present Invention.

TABLE 2

| Steel | Chemical Composition (wt %, Fe: bal.) | | | | | | | | | | | | | | | |
|---|---|---|---|---|---|---|---|---|---|---|---|---|---|---|---|---|
| No. | C | Si | Mn | P | S | Cr | O | N | B | Nb | V | Ni | Mo | La | Ce | Remarks |
| 29 | 0.82 | 0.30 | 0.41 | 0.009 | 0.010 | — | 0.0030 | 0.0040 | — | 0.0020 | — | — | — | — | — | ○ |
| 30 | 0.80 | 0.31 | 0.40 | 0.009 | 0.009 | — | 0.0029 | 0.0039 | — | 0.0100 | — | — | — | — | — | ○ |
| 31 | 0.82 | 0.31 | 0.42 | 0.010 | 0.009 | — | 0.0028 | 0.0038 | 0.0050 | 0.0050 | — | — | — | — | — | ○ |
| 32 | 0.80 | 0.30 | 0.40 | 0.009 | 0.009 | — | 0.0029 | 0.0039 | — | — | 0.010 | — | — | — | — | ○ |
| 33 | 0.81 | 0.32 | 0.41 | 0.010 | 0.008 | — | 0.0030 | 0.0040 | — | — | 0.10 | — | — | — | — | ○ |
| 34 | 0.80 | 0.31 | 0.42 | 0.009 | 0.010 | — | 0.0029 | 0.0039 | — | — | 0.30 | — | — | — | — | ○ |
| 35 | 0.80 | 0.30 | 0.42 | 0.009 | 0.008 | — | 0.0030 | 0.0040 | — | — | — | 0.005 | — | — | — | ○ |
| 36 | 0.83 | 0.31 | 0.40 | 0.009 | 0.010 | — | 0.0029 | 0.0039 | — | — | — | 0.50 | — | — | — | ○ |
| 37 | 0.80 | 0.32 | 0.42 | 0.010 | 0.009 | — | 0.0030 | 0.0040 | — | — | — | 1.00 | — | — | — | ○ |
| 38 | 0.80 | 0.30 | 0.42 | 0.009 | 0.009 | — | 0.0029 | 0.0039 | — | — | — | — | 0.010 | — | — | ○ |
| 39 | 0.82 | 0.30 | 0.40 | 0.010 | 0.010 | — | 0.0030 | 0.0040 | — | — | — | — | 0.10 | — | — | ○ |
| 40 | 0.80 | 0.31 | 0.40 | 0.009 | 0.010 | — | 0.0028 | 0.0038 | — | — | — | — | 0.20 | — | — | ○ |
| 41 | 0.80 | 0.31 | 0.42 | 0.008 | 0.008 | 0.32 | 0.0029 | 0.0039 | — | — | 0.10 | 0.50 | — | — | — | ○ |
| 42 | 0.81 | 0.30 | 0.40 | 0.009 | 0.009 | 0.30 | 0.0030 | 0.0040 | — | — | — | 0.50 | 0.10 | — | — | ○ |
| 43 | 0.80 | 0.31 | 0.42 | 0.010 | 0.008 | 0.31 | 0.0030 | 0.0040 | — | — | 0.10 | 0.50 | 0.10 | — | — | ○ |
| 44 | 0.80 | 0.30 | 0.40 | 0.010 | 0.008 | — | 0.0030 | 0.0040 | — | — | — | — | — | 0.010 | — | ○ |
| 45 | 0.83 | 0.31 | 0.42 | 0.010 | 0.009 | — | 0.0030 | 0.0040 | — | — | — | — | — | 0.10 | — | ○ |
| 46 | 0.80 | 0.31 | 0.41 | 0.008 | 0.010 | — | 0.0030 | 0.0040 | — | — | — | — | — | 0.010 | ○ | |
| 47 | 0.81 | 0.30 | 0.40 | 0.010 | 0.010 | — | 0.0030 | 0.0039 | — | — | — | — | — | — | 0.10 | ○ |
| 48 | 0.80 | 0.30 | 0.41 | 0.009 | 0.008 | 0.30 | 0.0030 | 0.0040 | 0.0024 | 0.0027 | 0.10 | 0.50 | 0.10 | 0.010 | 0.010 | ○ |

TABLE 2-continued

| Steel | Chemical Composition (wt %, Fe: bal.) | | | | | | | | | | | | | | | |
|---|---|---|---|---|---|---|---|---|---|---|---|---|---|---|---|---|
| No. | C | Si | Mn | P | S | Cr | O | N | B | Nb | V | Ni | Mo | La | Ce | Remarks |

Note:
1. Underlined values are beyond the scope of the Present Invention.
2. "○" indicates the composition of the Present Invention.

The conditions of the thermomechanical treatment were as follows;

1) Heating temperature of the steel wire rods . . . 950° C.
2) Initiating temperature of deformation . . . 800° C.
3) Finishing temperature of deformation . . . 700° C.
4) Deformation (% reduction in area) . . . 60%
5) Initiating temperature of phase transformation . . . 600° C.
6) Finishing temperature of phase transformation . . . 570° C.

Characteristics and metallographic structures of the steel wire obtained by the thermomechanical treatment are listed in Tables 3 and 4.

These steel wires were pickled and cold-drawn to make the steel wire products, which were then subjected to tensile tests, twisting tests, and fatigue tests for evaluation. The cold-work reduction and the results of evaluation tests are listed together in Tables 3 and 4.

The strength of the steel wire is over 130 kgf/mm$^2$ and that of the wire products is over 410 kgf/mm$^2$ for the embodiment of this invention where all the conditions are in accordance with the specifications of this invention. It is also clear that all the products have good characteristics as to reduction of area, number of twists, and fatigue properties.

TABLE 3

| | | Steel Wire (thermomechnically treated) | | | | | | Drawing Reduction | Steel Wire Product (cold-drawn) | | | | |
|---|---|---|---|---|---|---|---|---|---|---|---|---|---|
| Experiment No. | steel No. | d mm ϕ | TS kg/mm$^2$ | RA % | $d_B$ μm | λ μm | Ferrite % | Ratio ln ($A_0/A_n$) | TS kg/mm$^2$ | RA % | TN turns | $\sigma_w$ kg/mm$^2$ | Remarks |
| 1 | 1 | 3.5 | 103 | 44 | 4.0 | 0.10 | 1.0 | 4.0 | 340 | 37 | 20 | 67 | |
| 2 | 2 | 3.5 | 119 | 54 | 4.0 | 0.10 | 1.0 | 4.15 | 410 | 50 | 35 | 136 | ○ |
| 3 | 3 | 3.5 | 130 | 56 | 4.0 | 0.10 | 0.5 | 4.15 | 410 | 51 | 34 | 139 | ○ |
| 4 | 4 | 3.5 | 140 | 53 | 4.0 | 0.10 | 0.5 | 4.15 | 417 | 50 | 32 | 141 | ○ |
| 5 | 5 | 3.5 | 117 | 29 | 4.0 | 0.10 | 1.0 | 3.7 | 389 | 25 | 15 | 40 | |
| 6 | 6 | 3.5 | 115 | 43 | 4.0 | 0.10 | 1.0 | 4.15 | 401 | 37 | 20 | 115 | |
| 7 | 7 | 3.5 | 131 | 53 | 4.0 | 0.10 | 1.0 | 4.15 | 412 | 41 | 35 | 135 | ○ |
| 8 | 8 | 3.5 | 141 | 56 | 4.0 | 0.10 | 1.0 | 4.15 | 420 | 40 | 34 | 139 | ○ |
| 9 | 9 | 3.5 | 137 | 38 | 4.0 | 0.10 | 1.0 | 3.5 | 375 | 30 | 17 | 42 | |
| 10 | 10 | 3.5 | 114 | 41 | 4.0 | 0.10 | 1.0 | 4.15 | 389 | 40 | 20 | 111 | |
| 11 | 11 | 3.5 | 132 | 51 | 4.0 | 0.10 | 1.0 | 4.15 | 411 | 51 | 35 | 139 | ○ |
| 12 | 12 | 3.5 | 140 | 53 | 4.0 | 0.10 | 1.0 | 4.15 | 415 | 52 | 34 | 139 | ○ |
| 13 | 13 | 3.5 | 137 | 32 | 4.0 | 0.10 | 1.0 | 3.5 | 375 | 30 | 17 | 42 | |
| 14 | 14 | 3.5 | 132 | 57 | 4.0 | 0.10 | 1.0 | 4.15 | 412 | 53 | 35 | 139 | ○ |
| 15 | 15 | 3.5 | 134 | 54 | 4.0 | 0.10 | 1.0 | 4.15 | 413 | 52 | 34 | 139 | ○ |
| 16 | 16 | 3.5 | 132 | 39 | 4.0 | 0.10 | 1.0 | 3.7 | 400 | 31 | 17 | 125 | |
| 17 | 17 | 3.5 | 131 | 58 | 4.0 | 0.10 | 1.0 | 4.15 | 412 | 53 | 35 | 138 | ○ |
| 18 | 18 | 3.5 | 132 | 55 | 4.0 | 0.10 | 1.0 | 4.15 | 413 | 52 | 34 | 140 | ○ |
| 19 | 19 | 3.5 | 131 | 39 | 4.0 | 0.10 | 1.0 | 3.7 | 400 | 32 | 17 | 126 | |
| 20 | 20 | 3.5 | 139 | 53 | 4.0 | 0.10 | 1.0 | 4.15 | 421 | 52 | 35 | 137 | ○ |
| 21 | 21 | 3.5 | 147 | 53 | 4.0 | 0.10 | 1.0 | 4.15 | 446 | 52 | 34 | 140 | ○ |
| 22 | 22 | 3.5 | 151 | 52 | 4.0 | 0.10 | 0.5 | 4.15 | 451 | 51 | 32 | 141 | ○ |
| 23 | 23 | 3.5 | 132 | 55 | 4.0 | 0.10 | 1.0 | 4.15 | 412 | 52 | 34 | 139 | ○ |
| 24 | 24 | 3.5 | 131 | 46 | 4.0 | 0.10 | 1.0 | 3.7 | 380 | 37 | 17 | 125 | |
| 25 | 25 | 3.5 | 132 | 54 | 4.0 | 0.10 | 1.0 | 4.15 | 413 | 51 | 33 | 138 | ○ |
| 26 | 26 | 3.5 | 130 | 40 | 4.0 | 0.10 | 1.0 | 3.7 | 397 | 33 | 17 | 125 | |
| 27 | 27 | 3.5 | 131 | 53 | 4.0 | 0.10 | 1.0 | 4.15 | 415 | 51 | 34 | 140 | ○ |
| 28 | 28 | 3.5 | 132 | 59 | 4.0 | 0.10 | 1.0 | 4.15 | 414 | 56 | 37 | 143 | ○ |

Note:
"○" indicates an example of the Present Invention.

TABLE 4

| Experiment No. | steel No. | Steel Wire (thermomechnically treated) d mm ϕ | TS kg/mm² | RA % | $d_B$ μm | λ μm | Ferrite % | Drawing Reduction Ratio ln ($A_0/A_n$) | Steel Wire Product (cold-drawn) TS kg/mm² | RA % | TN turns | $\sigma_w$ kg/mm² | Remarks |
|---|---|---|---|---|---|---|---|---|---|---|---|---|---|
| 29 | 29 | 3.5 | 132 | 564 | 4.0 | 0.10 | 1.0 | 4.15 | 415 | 51 | 34 | 139 | ○ |
| 30 | 30 | 3.5 | 133 | 62 | 3.0 | 0.10 | 1.0 | 4.15 | 420 | 55 | 34 | 143 | ○ |
| 31 | 31 | 3.5 | 133 | 55 | 3.0 | 0.10 | 1.0 | 4.15 | 415 | 52 | 34 | 139 | ○ |
| 32 | 32 | 3.5 | 142 | 50 | 3.0 | 0.10 | 1.0 | 4.15 | 421 | 47 | 30 | 143 | ○ |
| 33 | 33 | 3.5 | 144 | 49 | 3.0 | 0.10 | 1.0 | 4.15 | 430 | 48 | 31 | 145 | ○ |
| 34 | 34 | 3.5 | 148 | 47 | 3.0 | 0.10 | 1.0 | 4.15 | 449 | 43 | 31 | 147 | ○ |
| 35 | 35 | 3.5 | 140 | 49 | 3.0 | 0.10 | 1.0 | 4.15 | 413 | 49 | 30 | 143 | ○ |
| 36 | 36 | 3.5 | 141 | 47 | 3.0 | 0.10 | 1.0 | 4.15 | 416 | 47 | 37 | 146 | ○ |
| 37 | 37 | 3.5 | 143 | 49 | 3.0 | 0.10 | 1.0 | 4.15 | 420 | 48 | 31 | 148 | ○ |
| 38 | 38 | 3.5 | 141 | 44 | 3.0 | 0.10 | 1.0 | 4.15 | 413 | 45 | 30 | 143 | ○ |
| 39 | 39 | 3.5 | 147 | 42 | 3.0 | 0.10 | 1.0 | 4.15 | 429 | 46 | 32 | 141 | ○ |
| 40 | 40 | 3.5 | 155 | 42 | 3.0 | 0.10 | 1.0 | 4.15 | 455 | 43 | 30 | 147 | ○ |
| 41 | 41 | 3.5 | 150 | 43 | 4.0 | 0.10 | 1.0 | 4.15 | 460 | 42 | 22 | 144 | ○ |
| 42 | 42 | 3.5 | 151 | 41 | 4.0 | 0.10 | 1.0 | 4.15 | 462 | 41 | 23 | 145 | ○ |
| 43 | 43 | 3.5 | 153 | 41 | 4.0 | 0.10 | 1.0 | 4.15 | 465 | 40 | 21 | 147 | ○ |
| 44 | 44 | 3.5 | 132 | 58 | 3.0 | 0.10 | 1.0 | 4.15 | 417 | 51 | 35 | 144 | ○ |
| 45 | 45 | 3.5 | 134 | 60 | 2.0 | 0.10 | 1.0 | 4.15 | 422 | 54 | 37 | 146 | ○ |
| 46 | 46 | 3.5 | 132 | 58 | 3.0 | 0.10 | 1.0 | 4.15 | 417 | 52 | 35 | 145 | ○ |
| 47 | 47 | 3.5 | 135 | 60 | 2.0 | 0.10 | 1.0 | 4.15 | 423 | 56 | 37 | 147 | ○ |
| 48 | 48 | 3.5 | 160 | 57 | 2.0 | 0.10 | 1.0 | 4.15 | 462 | 50 | 35 | 151 | ○ |

Note:
"○" indicates an example of the Present Invention.

A comparison between the characteristics of wire rods was made, for which steel wire rod No.3 in Table 1 was worked through the thermomechanical treatment process as shown in FIG. 4 (*b*), with a scope of variation in experimental conditions as shown in No's. 29–63 given in Table 5. The results are shown in Table 6.

The effect of the initial working temperature was examined by experiments No's 29–52, that of the finishing temperature of work by experiments No's 53–56, that of the rate of total reduction in cross sectional area by experiment No's 57–59, and that of the temperatures of initiation and termination of phase transformation by experiments No's 60–63, respectively.

These wire rods were subsequently pickled, lubricated, and cold-worked to obtain the steel wire products, which were then subjected to tensile tests, twisting tests, and fatigue tests for evaluation. The cold-work reduction and the results of evaluation tests are listed together in Table 6.

Good mechanical characteristics besides tensile strength are realized in the embodiments of this invention where all the conditions are within the range of this invention. Thus, by the procedures in accordance with this invention, high carbon steel wire suitable for producing high strength steel wire products can be continuously manufactured.

TABLE 5

| Experiment No. | steel No. | Heating Temperature °C. | Initiating Temperature of Deformation °C. | Finishing Temperature of Deformation °C. | Deformation (Reduction in Area) % | Initiating Temperature of Transformation °C. | Finishing Temperature of Transformation °C. | Remarks |
|---|---|---|---|---|---|---|---|---|
| 49 | 3 | 950 | 900 | 650 | 60 | 620 | 570 | |
| 50 | 3 | 950 | 850 | 650 | 60 | 620 | 570 | ○ |
| 51 | 3 | 950 | 750 | 650 | 60 | 620 | 570 | ○ |
| 52 | 3 | 950 | 740 | 650 | 60 | 620 | 570 | |
| 53 | 3 | 950 | 850 | 750 | 60 | 620 | 570 | |
| 54 | 3 | 950 | 850 | 720 | 60 | 620 | 570 | ○ |
| 55 | 3 | 950 | 850 | 680 | 60 | 620 | 570 | ○ |
| 56 | 3 | 950 | 850 | 640 | 60 | 620 | 570 | |
| 57 | 3 | 950 | 850 | 700 | 10 | 620 | 570 | |
| 58 | 3 | 950 | 850 | 700 | 20 | 620 | 570 | ○ |
| 59 | 3 | 950 | 850 | 700 | 80 | 620 | 570 | ○ |
| 60 | 3 | 950 | 850 | 700 | 60 | 660 | 600 | |
| 61 | 3 | 950 | 850 | 700 | 60 | 650 | 600 | ○ |
| 62 | 3 | 950 | 850 | 700 | 60 | 600 | 550 | ○ |
| 63 | 3 | 950 | 850 | 700 | 60 | 600 | 540 | |

Note:
"○" indicates an example of the Present Invention.

TABLE 6

| Experiment No. | steel No. | Steel Wire (thermomechnically treated) d mm ϕ | TS kg/mm² | RA % | $d_B$ μm | λ μm | Ferrite % | Drawing Reduction Ratio ln ($A_0/A_n$) | Steel Wire Product (cold-drawn) TS kg/mm² | RA % | TN turns | $\sigma_w$ kg/mm² | Remarks |
|---|---|---|---|---|---|---|---|---|---|---|---|---|---|
| 49 | 3 | 3.5 | 130 | 33 | 8.5 | 0.10 | 1.0 | 3.7 | 379 | 31 | 17 | 115 | |
| 50 | 3 | 3.5 | 132 | 43 | 4.0 | 0.10 | 1.0 | 4.15 | 415 | 43 | 30 | 139 | ○ |
| 51 | 3 | 3.5 | 135 | 50 | 3.5 | 0.10 | 1.0 | 4.15 | 427 | 46 | 33 | 141 | ○ |
| 52 | 3 | 3.5 | 130 | 42 | 4.0 | 0.10 | 2.0 | 3.7 | 397 | 35 | 17 | 120 | |
| 53 | 3 | 3.5 | 130 | 38 | 4.0 | 0.10 | 1.0 | 3.7 | 397 | 33 | 19 | 121 | |
| 54 | 3 | 3.5 | 132 | 45 | 4.0 | 0.10 | 1.0 | 4.15 | 413 | 43 | 30 | 139 | ○ |
| 55 | 3 | 3.5 | 134 | 50 | 4.0 | 0.10 | 1.0 | 4.15 | 421 | 47 | 32 | 141 | ○ |
| 56 | 3 | 3.5 | 130 | 40 | 4.0 | 0.10 | 2.0 | 3.7 | 396 | 35 | 17 | 120 | |
| 57 | 3 | 5.2 | 130 | 37 | 7.5 | 0.10 | 1.0 | 3.7 | 380 | 32 | 17 | 117 | |
| 58 | 3 | 4.9 | 132 | 43 | 4.0 | 0.10 | 1.0 | 4.15 | 417 | 43 | 30 | 140 | ○ |
| 59 | 3 | 2.45 | 135 | 60 | 2.5 | 0.10 | 1.0 | 4.15 | 432 | 46 | 34 | 141 | ○ |
| 60 | 3 | 3.5 | 126 | 42 | 4.0 | 0.12 | 1.0 | 4.15 | 403 | 40 | 22 | 137 | |
| 61 | 3 | 3.5 | 133 | 44 | 4.0 | 0.10 | 1.0 | 4.15 | 420 | 44 | 35 | 140 | ○ |
| 62 | 3 | 3.5 | 140 | 44 | 4.0 | 0.09 | 1.0 | 4.15 | 435 | 42 | 30 | 144 | ○ |
| 63 | 3 | 3.5 | 131 | 31 | 4.0 | Bainite | 1.0 | 3.7 | 389 | 35 | 19 | 120 | |

Note:
"○" indicates an example of the Present Invention.

From the results of the examples, it can be understood that the steel wire of this invention has a tensile strength in excess of 130kgf/mm². The finishing cold-work with this material renders a high strength steel wire product with, even after a high degree of work up to the work reduction ratio (l n ϵ≧4.0), a level of strength beyond 410 kgf/mm², together with a contraction of area in the range of 40–50%, and the number of twists in excess of 30 turns, showing high ductility. The method according to this invention does not require repetitive working and heat treatment.

We claim:

1. A steel wire for making a high strength steel wire product containing, in % by weight, 0.6–1.1% C, 0.2–0.6% Si, 0.3–0.8% Mn, and impurities of max 0.010% P, max 0.010% S, max 0.003% O(oxygen), and max 0.004% N, and having a structure in which the maximum pearlite block size is 4.0 μm, the maximum separation distance in pearlite lamellar structure is 0.1 μm, and the maximum content of free ferrite is 1% by volume.

2. A steel wire for making a high strength steel wire product consisting, in % by weight, of 0.6–1.1% C, 0.2–0.6% Si, 0.30–0.8% Mn, 0–0.005% B, 0–0.010% Nb, 0–1.0% Cr, 0–0.3% V, 0–1.0% Ni, 0–0.20% Mo, and one or more rare earth metals of 0–0.10%, respectively, and impurities of max 0.010% P, max 0.010% S, max 0.003% O(oxygen), and max 0.004% N, and the balance Fe, and having a structure in which the maximum pearlite block size is 4.0 μm, the maximum separation distance in pearlite lamellar structure is 0.1 μm, and the maximum content of free ferrite is 1% by volume.

3. A method for manufacturing a steel wire for making a high strength steel wire product comprising steps of:

heating a steel wire rod containing, in % by weight, 0.6–1.1% C, 0.2– 0.6% Si, 0.3–0.8% Mn, and impurities of max 0.010% P, max 0.010% S, max 0.003% O(oxygen), and max 0.004% N to the austenite range above $Ac_3$ point or $A_{cm}$ point, initiating plastic deformation to be no less than 20% total reduction in cross-sectional area in the temperature range 850° C.–750° C., finishing plastic deformation between the temperatures of $Ae_1$ point and 650° C., and cooling continuously to the range between 650° C. and 550° C., and thus transforming austenite into the pearlite phase.

4. A method for manufacturing a steel wire for making a high strength steel wire product comprising steps of:

heating a steel wire rod consisting, in % by weight, 0.6–1.1% C, 0.2–0.6% Si, 0.3–0.8% Mn, 0–0.005% B, 0–0.010% Nb, 0–1.0% Cr, 0–0.3% V, 0–1.0% Ni, 0–0.20 % Mo, and one or more rare earth metals of 0–0.10%, respectively, and impurities of max 0.010% P, max 0.010% S, max 0.003% O(oxygen), and max 0.004% N, and the balance Fe to the austenite range above $AC_3$ point or $A_{cm}$ point, initiating plastic deformation to be no less than 20% total reduction in cross-sectional area in the temperature range 850° C.–750° C., finishing the plastic deformation between the temperatures of $Ae_1$ point and 650° C., and cooling continuously to the range between 650° C. and 550° C., and thus transforming austenite into the pearlite phase.

5. The steel wire of claim 1, further comprising 0.1 to 1.0% Cr.

6. The steel wire of claim 2, further comprising 0.1 to 1.0% Cr.

7. The method of claim 3, wherein the steel wire rod further comprises 0.1 to 1.0% Cr.

8. The method of claim 4, wherein the steel wire rod further comprises 0.1 to 1.0% Cr.

9. A steel wire product made from the steel wire of claim 1, having a tensile strength above 410 kgf/mm².

10. A steel wire product made from the steel wire of claim 2, having a tensile strength above 410 kgf/mm ².

11. The method of claim 3, further comprising cold working the wire rod and producing a steel wire product having a tensile strength above 410 kgf/mm².

12. The method of claim 4, further comprising cold working the wire rod and producing a steel wire product having a tensile strength above 410 kgf/mm².

13. A steel wire product made from the steel wire of claim 1, having a reduction of area in the range of 40–50%.

14. A steel wire product made from the steel wire of claim 2, having a reduction of area in the range of 40–50%.

15. The method of claim 3, further comprising cold working the wire rod and producing a steel wire product having a reduction of area in the range of 40– 50%.

16. The method of claim 4, further comprising cold working the wire rod and producing a steel wire product having a reduction of area in the range of 40– 50%.

17. The method of claim 3, wherein subsequent to the cooling step the steel wire has a maximum pearlite block size of 4.0 μm, a maximum separation distance in pearlite lamellar structure of 0.1 mm and a maximum ferrite content of 1% by volume.

18. The method of claim 4, wherein subsequent to the cooling step the steel wire has a maximum pearlite block size of 4.0 μm, a maximum separation distance in pearlite lamellar structure of 0.1 mm and a maximum ferrite content of 1% by volume.

* * * * *